US006457260B1

(12) United States Patent
Roelofs

(10) Patent No.: US 6,457,260 B1
(45) Date of Patent: Oct. 1, 2002

(54) FOOTWEAR WITH ATTACHABLE COVERING

(76) Inventor: Thomas E. Roelofs, 302 S. Wayne St., Arlington, VA (US) 22204

( * ) Notice: Subject to any disclaimer, the term of this patent is extended or adjusted under 35 U.S.C. 154(b) by 0 days.

(21) Appl. No.: 09/863,289

(22) Filed: May 24, 2001

(51) Int. Cl.[7] ..... A41D 17/00; A43B 5/00

(52) U.S. Cl. ..... 36/1.5; 36/2 R; 36/136; 2/23

(58) Field of Search ..... 36/1.5, 2 R, 136, 36/2 A, 2 B; 2/23, 79, 242, 270

(56) References Cited

U.S. PATENT DOCUMENTS

| | | | | |
|---|---|---|---|---|
| 984,608 | A | | 2/1911 | Roberts |
| 1,061,740 | A | | 5/1913 | Gehant |
| 1,635,298 | A | | 7/1927 | Willette |
| 2,406,090 | A | * | 8/1946 | Mas |
| 2,432,648 | A | * | 12/1947 | Beckwith |
| 2,473,099 | A | | 6/1949 | Hatch |
| 3,174,234 | A | * | 3/1965 | Weitzner |
| 3,477,147 | A | | 11/1969 | Bauer |
| 3,618,232 | A | | 11/1971 | Shnuriwsky |
| 4,094,080 | A | * | 6/1978 | Sanders |
| 4,461,030 | A | | 7/1984 | Knudsen |
| 4,693,018 | A | | 9/1987 | Maleyko et al. |
| 4,726,126 | A | * | 2/1988 | Bernhard |
| 4,777,743 | A | | 10/1988 | Roehrig, Jr. |
| 4,817,306 | A | | 4/1989 | Bayer |
| 4,856,207 | A | | 8/1989 | Datson |
| 4,896,437 | A | * | 1/1990 | Johnson |
| 5,005,215 | A | * | 4/1991 | McIlquham |
| 5,623,772 | A | * | 4/1997 | Sunderland et al. |
| 5,642,573 | A | | 7/1997 | Brown |
| 5,897,446 | A | * | 4/1999 | Wiseman et al. |

FOREIGN PATENT DOCUMENTS

| | | |
|---|---|---|
| FR | 2601859 | 1/1988 |
| GB | 246685 | 2/1926 |

OTHER PUBLICATIONS

Winter 2001 Sierra Trading Post; 5025 Campstool Road, Cheyenne, WY 82007–1898; Overshoes by N.E.O.S. (For Men and Women); Blazer #161133N; Commuter #60929N; p. 27.

* cited by examiner

*Primary Examiner*—M. D. Patterson
(74) *Attorney, Agent, or Firm*—Wenderoth, Lind & Ponack, L.L.P.

(57) ABSTRACT

This invention pertains to enclosed footwear in combination with a leg covering or body covering that is storable within a compartment that is integral with an exterior of the enclosed footwear. The leg covering can be either a gaiter or a pants leg portion, and the body covering can be either a sack portion or a suit portion.

46 Claims, 9 Drawing Sheets

FOOTWEAR WITH ATTACHABLE COVERING

BACKGROUND OF THE INVENTION

This invention pertains to enclosed footwear in combination with a leg covering or body covering that is storable within a compartment that is integral with an exterior of the enclosed footwear. The leg covering can be either a gaiter or a pants leg portion, and the body covering can be either a sack portion or a suit portion.

When a person is performing an outdoor activity, in order for safety reasons and in order to realize maximum enjoyment of the activity, it is imperative that his/her footwear be sufficient to provide adequate protection and comfort. A shoe or boot itself is often sufficient to provide adequate protection and comfort to the person; however, there are times when extra protection is required.

For example, when hiking or maneuvering through a stream or other wet area, a typical shoe or boot will not always prevent water from entering into the shoe or boot, such that the foot of the wearer becomes wet and uncomfortable. When hiking or maneuvering through a forest, jungle or other vegetation-filled terrain, a shoe or boot will not always prevent insects, twigs, snakes, etc. from entering into the shoe or boot, such that the foot of the wearer may be bitten or scratched. When hiking or maneuvering through deserts or beaches a shoe or boot will not always provide sufficient protection for preventing sand or other debris from entering into the shoe or boot. And, when hiking or maneuvering through snow, a shoe or boot will not always be sufficient to prevent snow or other moisture from entering the shoe or boot.

Additionally, a shoe or boot itself is often insufficient to protect the lower leg of the wearer from snake bites, bug bites, scratches from thorns, etc.

Accordingly, a shoe or boot itself may not always provide adequate protection to prevent unwanted matter from entering into the shoe or boot, and may not always provide adequate protection against bites or scratches to the lower leg, whereby hiking, maneuvering through adverse conditions, and performing other outdoor activities can be extremely uncomfortable and dangerous.

Thus, there exists a need for providing a shoe or boot that can prevent unwanted matter from entering the shoe or boot, whereby protection and comfort are provided to the wearer during any outdoor activity. Certain attempts have been made in the past to provide footwear that is provided with structure to prevent debris from entering the footwear. For example, U.S. Pat. No. 5,642,573 issued to Brown on Jul. 1, 1997 discloses a shoe with an integral storable gaiter. In the Brown patent, the shoe and gaiter are integrally joined with one another, and a pouch is provided into which the gaiter can be stored when not in use. The pouch is integral with the shoe and is secured at the ankle collar of the shoe. Because the gaiter of Brown is stored within a pouch at the ankle collar of the shoe, and because when the gaiter is stored in the pouch the shoe is intended to take on its ordinary appearance, the Brown shoe is of limited practicality.

In this regard, in order for the shoe of Brown to take on a normal appearance when the gaiter is stored within the pouch, the gaiter must be of a limited height when pulled from the pouch. Otherwise, the storage of the gaiter within the pouch would result in an unsightly bulge around the ankle collar, which would not be a normal appearance of the shoe. Thus, to preserve the shoe of Brown with its normal and ordinary appearance, which is stated by Brown to be an advantage of the shoe and gaiter thereof, the gaiter of the Brown patent could extend up the lower leg of the wearer for a very limited portion, whereby the protective functions performed by the gaiter would be limited.

The shoe of the Brown patent may provide adequate protection and comfort to the wearer's foot under certain very mild conditions. However, the Brown shoe would be inadequate to prevent unwanted debris from entering into the shoe while at the same time protecting the lower leg from bites, scratches and other potentially dangerous occurrences, when performing a wide variety of outdoor activities, such as skiing, hiking, or otherwise maneuvering through jungles, deserts, deep snow or deep streams.

Accordingly, there remains a need to provide a shoe or boot that can prevent unwanted matter or debris from entering the shoe or boot, and protect the lower leg of the wearer from bites or scratches, such that adequate protection and comfort can be provided to the wearer even under adverse conditions.

OBJECT OF THE INVENTION

An object of this invention is to provide footwear which can be worn as a typical shoe or boot during non-adverse or non-dangerous hiking or maneuvering operations, and which can be modified into a shoe or boot providing protection for preventing debris or unwanted matter from entering the shoe or boot, while also providing protection to at least the lower leg from bites, scratches and other unwanted occurrences, when the hiking or maneuvering operations are performed under adverse conditions.

SUMMARY OF THE INVENTION

In accordance with this invention, a shoe or boot is provided which can be worn as a typical shoe or boot under non-adverse conditions, and which can be modified to prevent unwanted matter from entering into the shoe or boot, while also protecting the lower leg from unwanted occurrences, during adverse hiking or maneuvering operations, in order to provide adequate comfort and protection to the wearer In order to accomplish this purpose, the shoe or boot is provided with a compartment, that is integral with and accessible from an exterior of the shoe or boot, and in which compartment is storable a leg covering or body covering that can be removed from the compartment and secured around the wearer's leg Because the compartment is accessible from an exterior of the shoe or boot, the compartment can define a large volume such that a large leg covering or body covering can be stored therein, whereby adequate protection and comfort can be provided even under adverse conditions.

The leg covering can either be a gaiter or a pants leg portion, and the body covering can either be a sack portion or a suit portion. The storage compartment can be located on the rear of the footwear and is closeable by a zipper or other appropriate structure. The storage compartment may be provided with a heating implement. The material defining the storage compartment can be stretchable, thereby allowing for easy storage of the leg covering, within the storage compartment. And, the size of the storage compartment can be individually designed to match the footwear with the leg covering or body covering.

The leg covering or body covering can be affixed to the footwear via thread or glue, or can be quickly removably attached to the footwear via a zipper, buttons, snaps, or hook and loop fasteners. The leg covering or body covering, and/or the footwear, can also be impregnated with an insect repellant.

When the leg covering is a gaiter, the gaiter is provided with structure to close the gaiter around a wearer's leg, and the lower portion of the gaiter can be provided with a hook or snap to be attached to cooperating structure on the footwear. The gaiter can also include a cinch member around its central portion and around its upper portion, such that the extent to which the gaiter covers the wearer's leg can be adjusted. When the gaiter is to cover a large portion of the wearer's leg the top of the gaiter is cinched around the wearer's leg, and when a gaiter is to cover a lesser extent of the wearer's leg the gaiter is loosened around the top portion, then folded over, and cinched around the central portion.

When the leg covering is a pants leg portion, the pants leg portion can be provided with a zipper or other structure at an upper portion thereof such that a pair of pants leg portions can be attached to each other at the crotch of the wearer to cover an even greater extent of the wearer's legs.

When the body covering is a sack portion, the sack portion can be provided with a zipper or other structure at an upper portion thereof such that a pair of sack portions can be attached to each other about the head and torso of the wearer to form a sack that substantially encloses the entire body of the wearer. Preferably, after the sack portions are attached to one another, an opening exists in the sack through which the wearer's face is exposed.

When the body covering is a suit portion, the suit portion includes a sleeve for receipt of the wearer's arm. The suit portion also includes a zipper or other structure at an upper portion thereof such that a pair of suit portions can be attached to each other about the head and torso of the wearer to form a suit that substantially encloses the entire body of the wearer, while not restricting use of the wearer's arms and hands. After the suit portions are attached to one another, an opening exists in the suit through which the wearer's face is exposed.

Provided in the storage compartment can be padding, such as a rubber pad, to prevent hooks or snaps of the gaiter, a zipper of the pants leg portion, sack portion or suit portion, or other hardware carried by the leg covering or body covering from causing discomfort to the wearer's leg when the leg covering or body covering is stored within the storage compartment.

DESCRIPTION OF THE PREFERRED EMBODIMENTS

Figure 1:
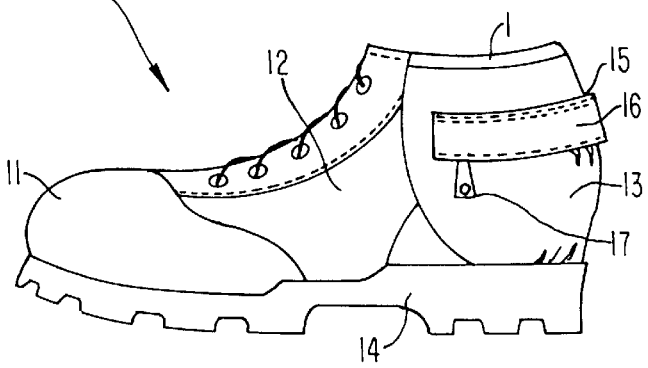
FIG. 1 is a perspective side view of a first embodiment of the invention with the gaiter in a stored position.
Figure 2:
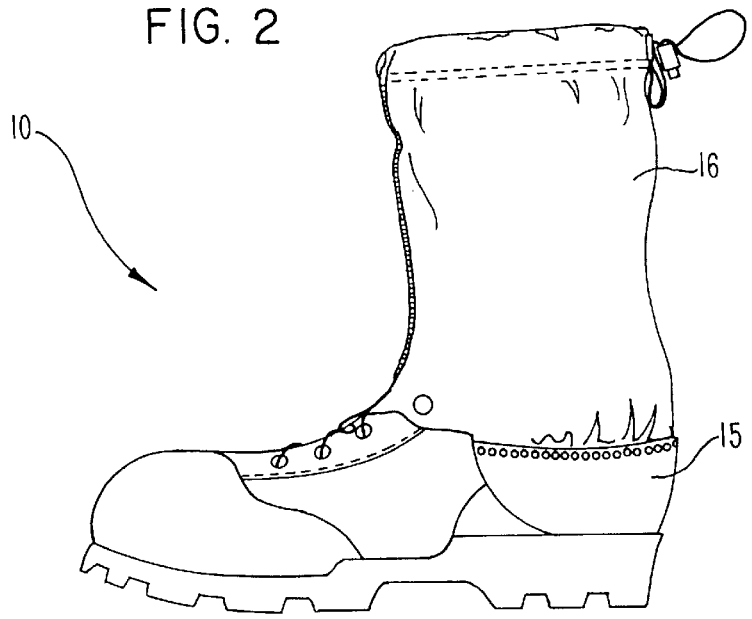
FIG. 2 is a perspective side view of the first embodiment of the invention with the gaiter in an extended position.

In accordance with a first embodiment of the invention as depicted in FIGS. 1 and 2, the footwear is a shoe that extends to about the ankle of the wearer and the gaiter extends upwardly from the shoe to about just below the calf of the wearer.

Figure 3:
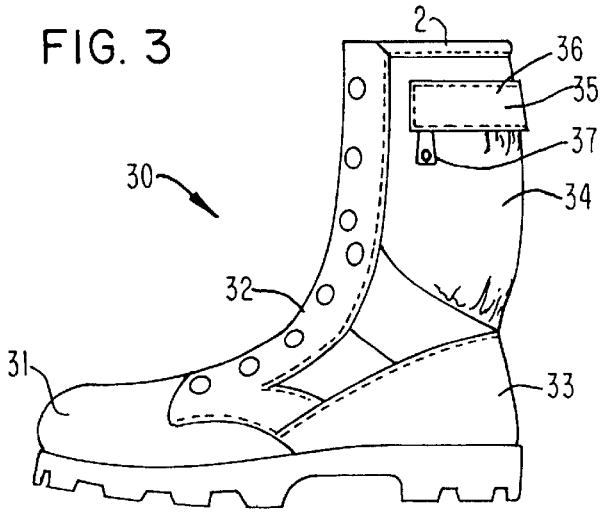
FIG. 3 is a perspective side view of a second embodiment of the invention with the gaiter in a stored position.
Figure 4:
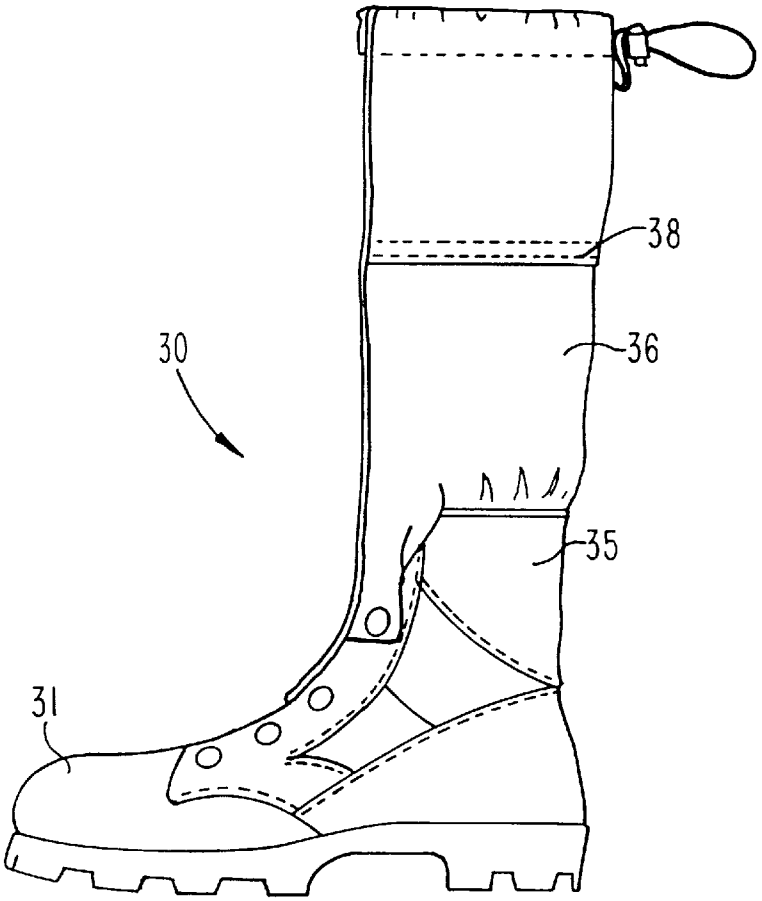
FIG. 4 is a perspective side view of the second embodiment of the invention with the gaiter in an extended position.

In accordance with a second embodiment of the present invention as depicted in FIGS. 3 and 4, the footwear is a mid-boot that extends to about the shin of the wearer and the gaiter extends to just below the knee of the wearer.

Figure 5:
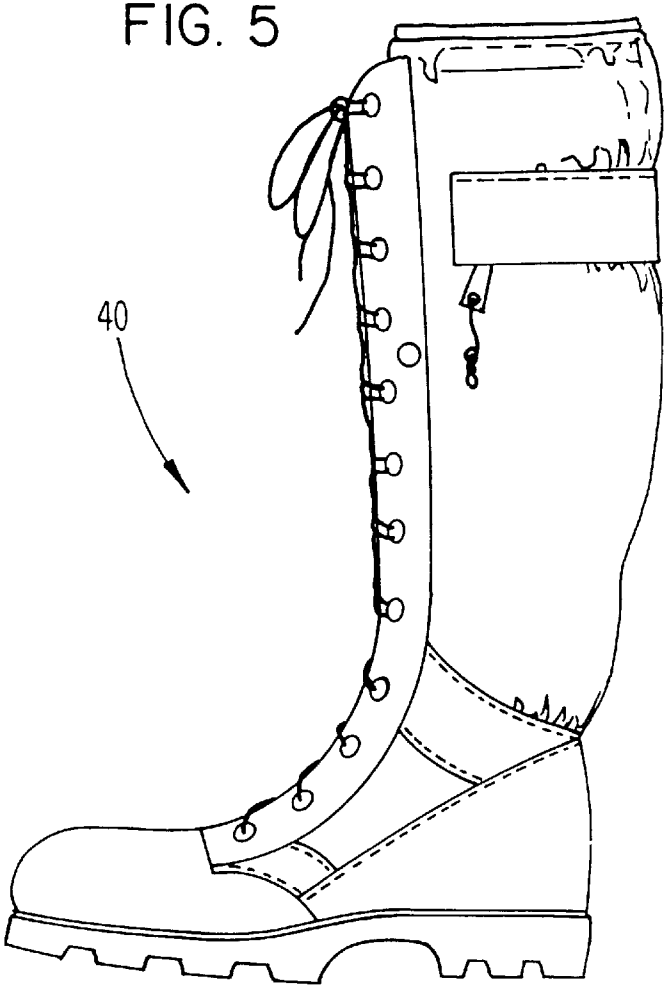
FIG. 5 is a perspective side view of a third embodiment of the present invention with the gaiter in a stored position.
Figure 6:
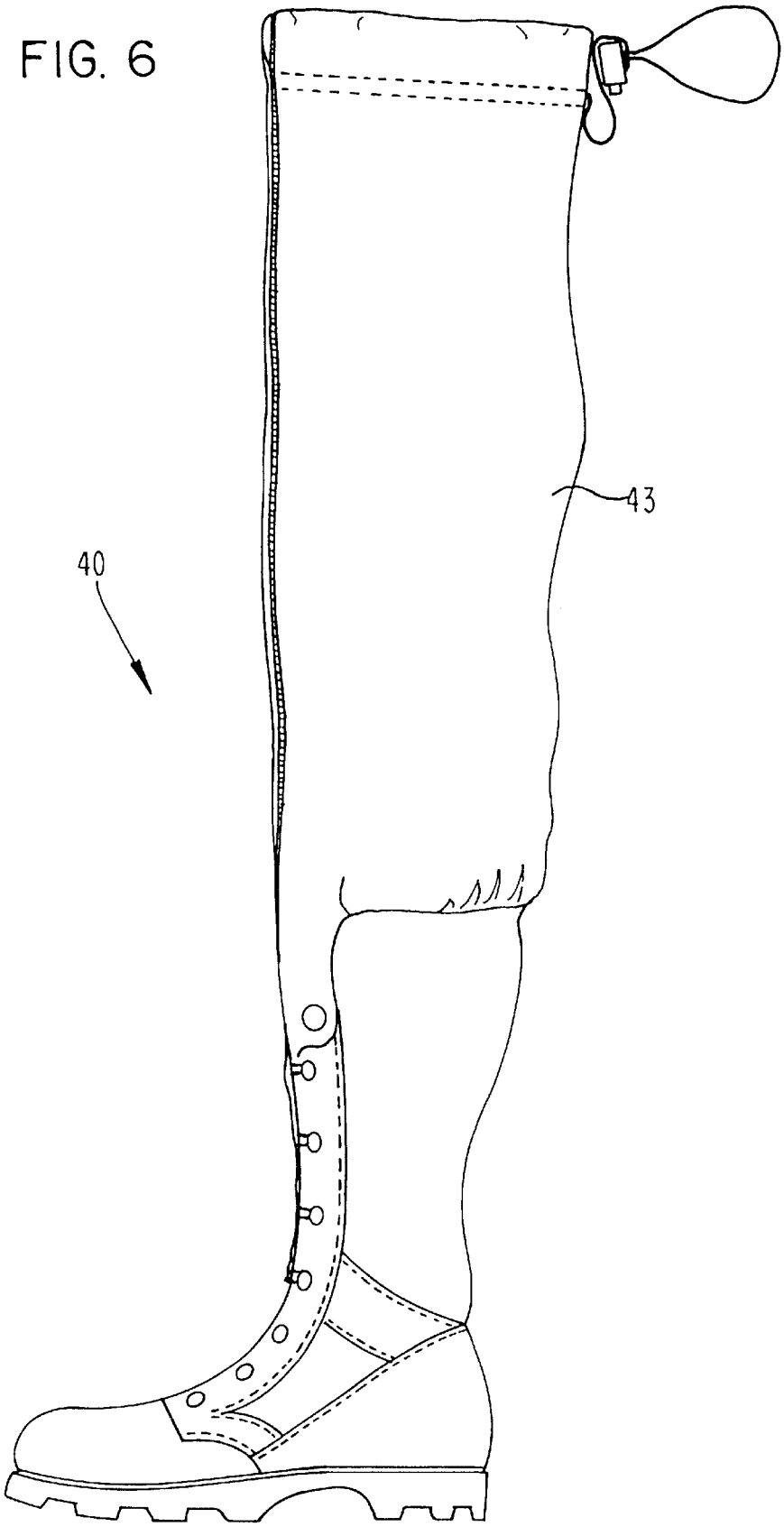
FIG. 6 is a perspective side view of the third embodiment of the invention with the gaiter in an extended position.

In accordance with a third embodiment of the present invention as depicted in FIGS. 5 and 6, the footwear is a high-boot which extends to about the calf of the wearer and the gaiter extends to about the thigh of the wearer.

Figure 10:
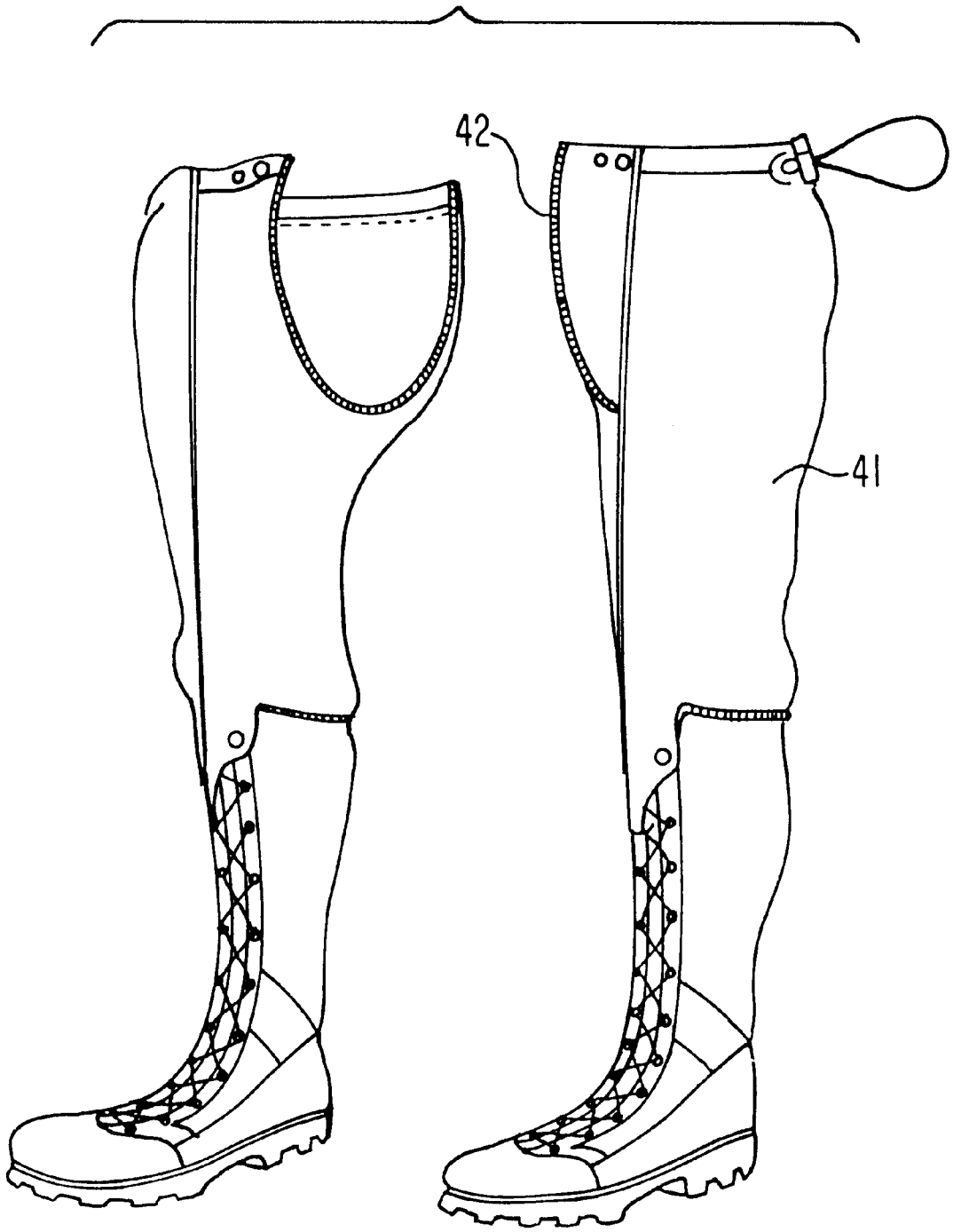
FIG. 10 is a perspective view of another aspect in accordance with the third embodiment of the invention.

In accordance with another aspect of the third embodiment of the present invention as depicted in FIG. 10, instead of the high-boot being provided with a gaiter, the high-boot is provided with a pants leg portion which is connectable via a zipper or other structure at the crotch area of the wearer to another pants leg portion associated with a second boot.

Figure 12:
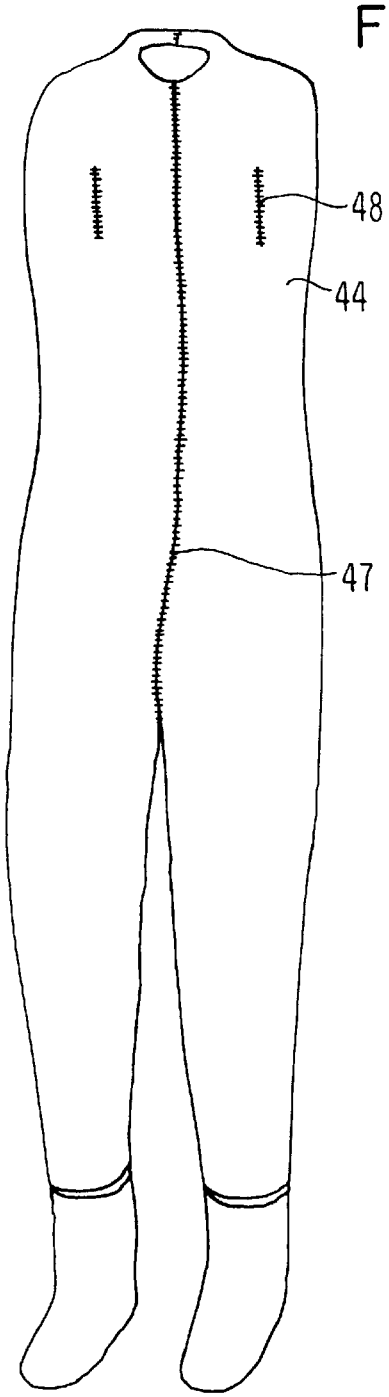
FIG. 12 is a perspective view of yet another aspect in accordance with the third embodiment of the invention.

In accordance with yet another aspect of the third embodiment as shown in FIG. 12, instead of the high-boot being provided with a gaiter or pants leg portion, the high-boot is provided with a sack portion which is connectable via a zipper or other structure about the head and torso of the wearer to another sack portion associated with a second boot.

Figure 13:
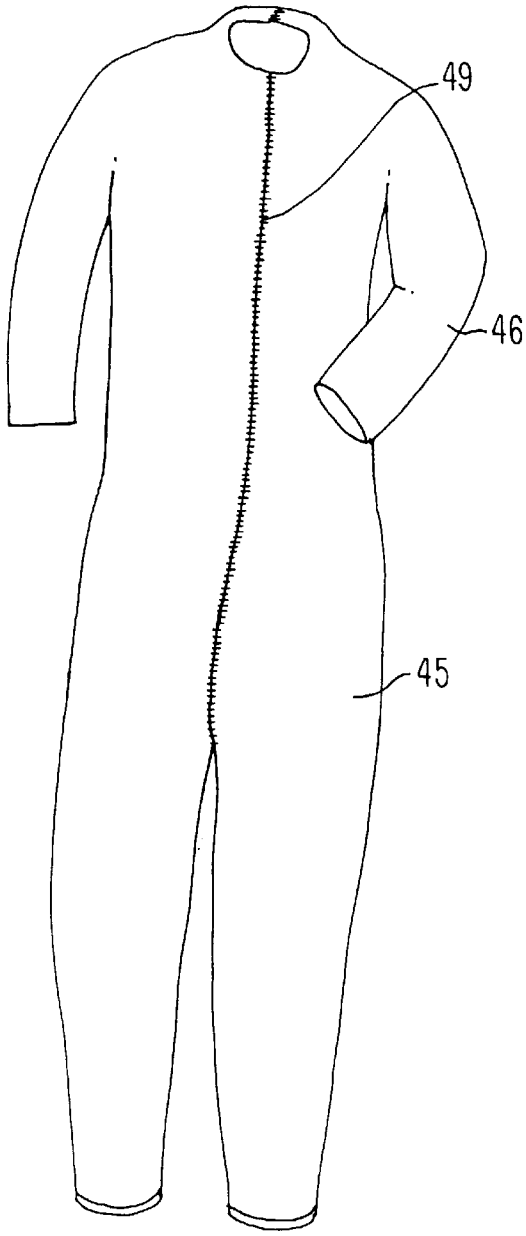
FIG. 13 is a perspective view of still another aspect in accordance with the third embodiment of the invention.

And, in accordance with still another aspect of the third embodiment as depicted in FIG. 13, instead of the high-boot being provided with a gaiter, pants leg portion or sack portion, the high boot is provided with a suit portion which is connectable via a zipper or other structure about the head and torso of the wearer to another suit portion associated with a second boot.

In accordance with the first embodiment of the invention as depicted in FIGS. 1 and 2, the footwear is a shoe 10 that extends to about the ankle of the wearer. The shoe 10 includes a toe receiving section 11, a mid-foot receiving section 12, a heel receiving section 13, a sole 14 and a collar portion 1. The collar portion 1 is located at an upper extremity of the heel receiving section 13. Provided integral with the heel receiving section 13 is a pocket or compartment 15. The pocket or compartment 15 is positioned beneath the collar portion 1. Within the pocket or compartment 15 is stored a gaiter 16. FIG. 1 shows the gaiter 16 stored within the pocket 15, which is closable by a zipper 17, and FIG. 2 shows the gaiter 16 removed from the pocket 15 and extending upwardly. FIGS. 1 and 2 depict side views, and accordingly, it is to be understood that the compartment or pocket 15 extends continuously on the side of the heel portion 13 not shown to substantially the same amount as it extends on the side of the heel portion 13 shown in the drawings. Similarly, the gaiter 16 extends on both sides of the heel portion 13 for substantially the same amount. The same is true with regard to each of the second and third embodiments.

Figure 7:
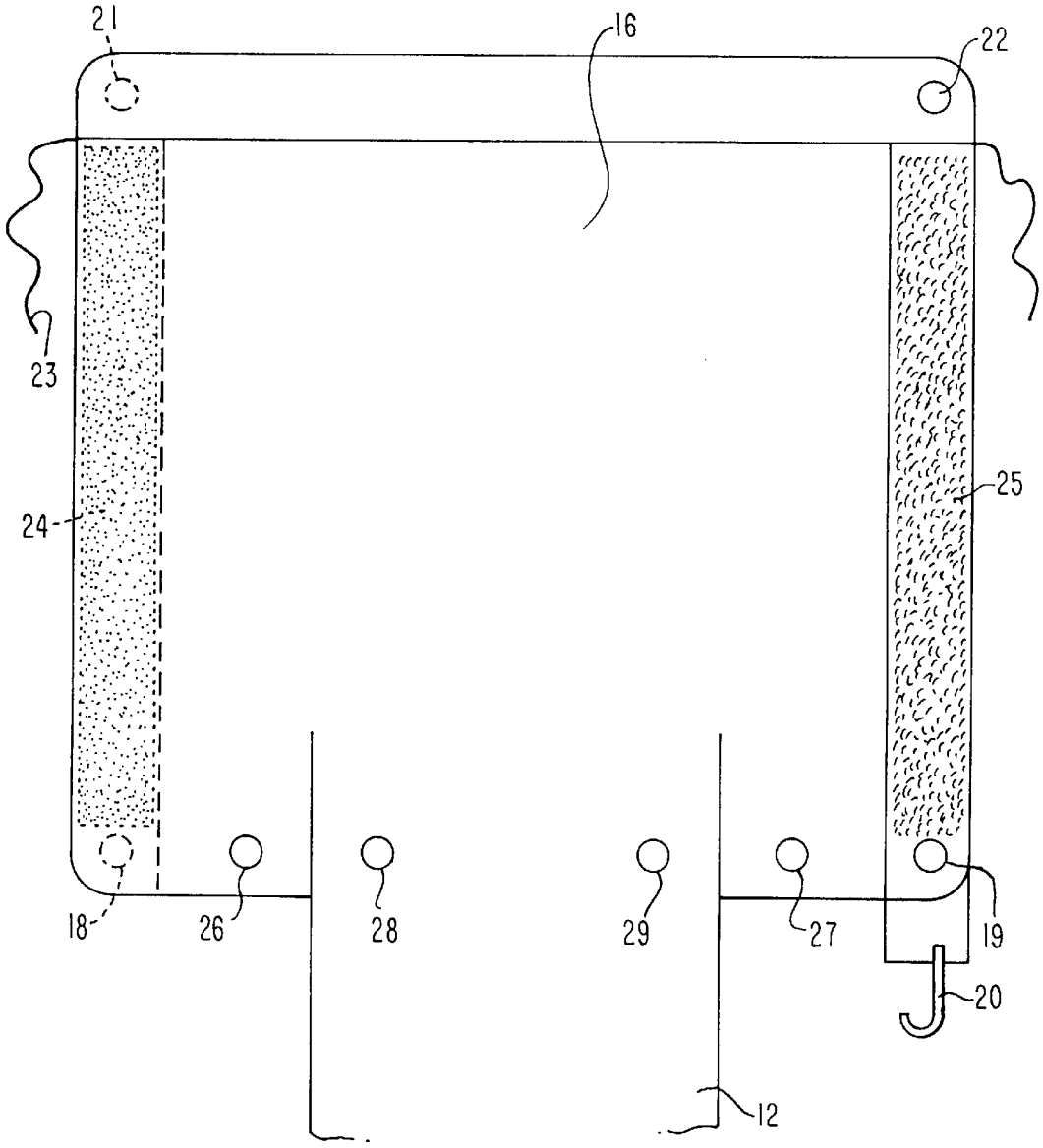
FIG. 7 is a schematic view of the gaiter used in each of the first, second, and third embodiments.

FIG. 7 shows the gaiter 16 extended from the pocket 15 before the gaiter 16 is secured around the leg of the wearer.

As can be seen in FIG. 7, the gaiter 16 comprises a generally planar sheet of material. Examples of the material are the material sold under the trademark GORTEX or a material similar thereto, and the material sold under the trademark KEVLAR or a material similar thereto. A lower mid portion of this material is sewn to a back portion of the interior of the compartment or pocket 15, while lateral sides of the sheet of material are positioned outside of the compartment or pocket 15. At respective lower corners of the sheet of material are positioned cooperating members 18 and 19 of a snap fastener. Positioned at one of the lower corners of the sheet of material is a hook 20. At respective upper corner portions of the sheet of material are provided cooperating members 21 and 22 of another snap fastener. Provided along the top portion of the sheet of material is a drawstring 23 or other cinch member by which the gaiter 16 can be tightened around the leg of wearer. Along respective lateral edges of the sheet of material are provided cooperating strips 24, 25 of a hook and loop fastener system, e.g. a fastener system sold under the trademark VELCRO. Adjacent the members 18 and 19 are provided first members 26 and 27 of snap fasteners, and provided on the mid-foot receiving portion 12 of the shoe 10 are provided second members 28 and 29 of the snap fasteners that respectively cooperate with the first members 26 and 27.

Instead of being sewn to the back portion of the interior of the compartment or pocket, the gaiter 16 can be attached to the back portion via a hook and loop fastener system, snaps, buttons, a zipper, glue or by any other appropriate manner. Additionally, the gaiter 16 can also be connected to any portion of the compartment other than the back portion of the interior of the compartment.

In place of snap fastener members 26, 27, 28 and 29, other cooperating structure can be provided on the sheet of material and the shoe 10. For example, hook and loop fastener straps can be provided in place of members 26 and 27, and receiving loops can be provided in place of members 28 and 29. Similarly, other cooperating structure can be provided on the sheet of material in place of fastener members 18, 19, 21, 22 and fastener strips 24, 25, so long as this other structure adequately secures the gaiter around the leg of the wearer.

Figure 9:
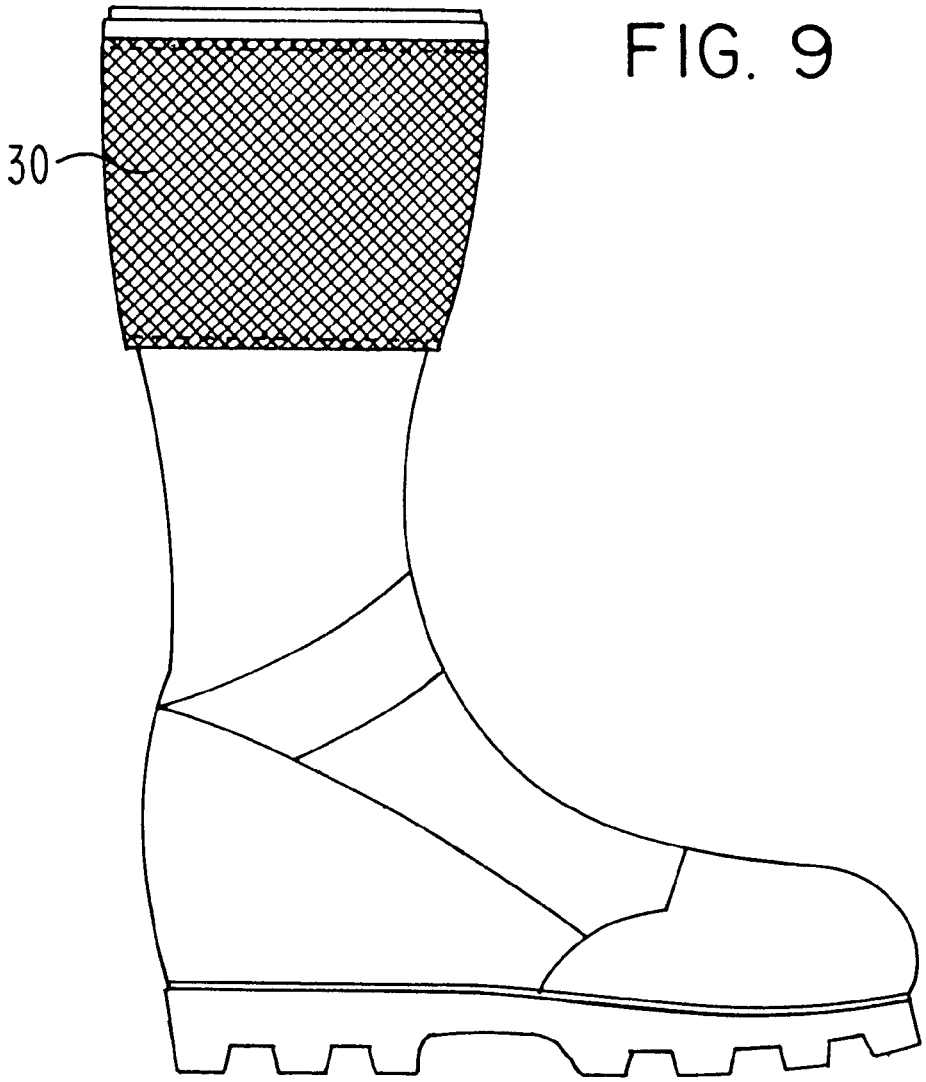
FIG. 9 is a perspective view of the boot of the second and third embodiments with the pocket and gaiter not shown.

When the gaiter 16 is not in use it can be folded and stored within the compartment or pocket 15. As is shown in FIG. 9, a rubber slab or other appropriate padding 30 can be provided within the compartment or pocket 15 and serves the purpose of preventing the members 18, 19, 21, 22, 26, 27 of the snap fasteners, or the hook 20, from causing discomfort to the wearer by being positioned between the heel of the wearer and the hook and snap fastener members when the gaiter is stored within the compartment or pocket. The zipper 17 can then be closed to maintain the gaiter 16 within the compartment or pocket 15 when the gaiter 16 is not in use. The padding 30 can be sewn or otherwise connected to a front portion of the interior of the compartment or pocket 15, or can be loosely positioned within the pocket or compartment 15. And, the padding 30 can be of any material so long as it adequately reduces the amount of discomfort experienced by the wearer.

When it is desired to secure the gaiter 16 around the leg of the wearer, the compartment or pocket 15 is opened by the zipper 17, and the gaiter 16 is removed from the compartment 15. Then, the gaiter 16 is deformed around the leg of the wearer, the hook and loop fastener strips 24 and 25 along the lateral edges of the gaiter 16 are attached to one another, the cooperating snap fastener members 21 and 22 at the upper corners of the gaiter 16 are secured with one another, the cooperating snap fastener members 18 and 19 at the lower corners of the gaiter 16 are secured with one another, the two snap fastener members 26 and 27 on the gaiter are respectively attached to the two snap fastener members 28 and 29 on the mid-foot receiving section 12 of the shoe 10, and the hook 20 is attached to laces of the shoe or a tubular member that surrounds a portion of the laces, if the mid-foot receiving section 12 is of the type that includes uppers which are laced together. If the shoe 10 is of the type which does not require any lacing, then the hook 20 can be attached to a ring or other structure carried on the mid-foot receiving section 12 of the shoe 10. The drawstring 23 is then tightened around the leg of the wearer.

Alternatively, when hook and look fastener straps are provided in place of members 26 and 27, and receiving loops are provided in place of members 28 and 29, to attach the gaiter 16 to the shoe 10, the hook and loop fastener straps are criss-crossed, passed through corresponding ones of the receiving loops, and then each of the straps is folded upon itself and secured to itself The hook 20 is optional, and is not required for securement of the gaiter 16 around the leg of the wearer.

The compartment or pocket 15 can be at least partially defined by a stretchable material such as the material sold under the trademark SPANDURA so that when the gaiter 16 is stored within the compartment or pocket 15, the material of the compartment or pocket 15 stretches or flexes, whereby the working volume of the compartment or pocket is increased, such that storage within the compartment is made easy. The stretchable material is sewn or otherwise secured to the exterior of the heel portion 13 of the shoe 10. Other stretchable materials can be used so long as the working volume of the compartment or pocket 15 is adequately increased. Or, the compartment or pocket 15 can be defined by a non-stretchable material, so long as the volume of the compartment or pocket 15 is large enough to adequately store the gaiter 16.

In accordance with the second embodiment of the invention as shown in FIGS. 3 and 4, the footwear comprises a mid-boot 30 that extends to about the shin of the wearer. The mid-boot includes a toe receiving portion 31, a mid-foot receiving portion 32, a heel receiving portion 33, a lower leg receiving section 34, a sole 38 and a collar portion 2. The collar portion 2 is located at an upper extremity of the lower leg receiving section 34. Provided on the lower leg receiving section 34 is a pocket or compartment 35 in which is stored a gaiter 36. The pocket or compartment 35 is positioned beneath the collar portion 2. The pocket or compartment 35 is closeable by a zipper 37. The gaiter is of the same general construction, but not necessarily the same size, as that depicted in FIG. 7 and described with regard to the first embodiment; and therefore a detailed description of the gaiter 36 is omitted. The compartment or pocket 35 is also of the same general construction as that described with regard to the first embodiment; however, the volume of the pocket or compartment 35 can differ from that of the compartment or pocket 15 depending upon the specific size and construction of the gaiter 36. The gaiter 36 is stored within the pocket 35 in a similar manner by which the gaiter 16 is stored within the pocket 15 of the shoe 10 as explained with regard to the first embodiment of the invention. And, the gaiter 36 is secured around the leg of the wearer in a similar manner to that which the gaiter 16 of the first embodiment of the invention is secured around the leg of the wearer.

Figure 8A:
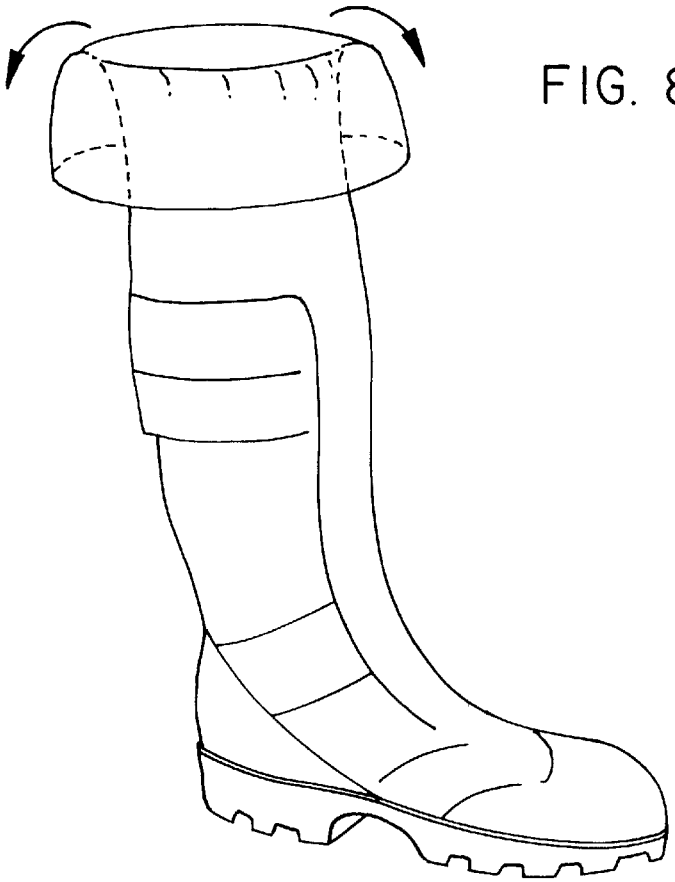
FIGS. 8A and 8B are perspective side views of the second embodiment showing how the extent of the leg that is covered by the gaiter can be modified.
Figure 8B:
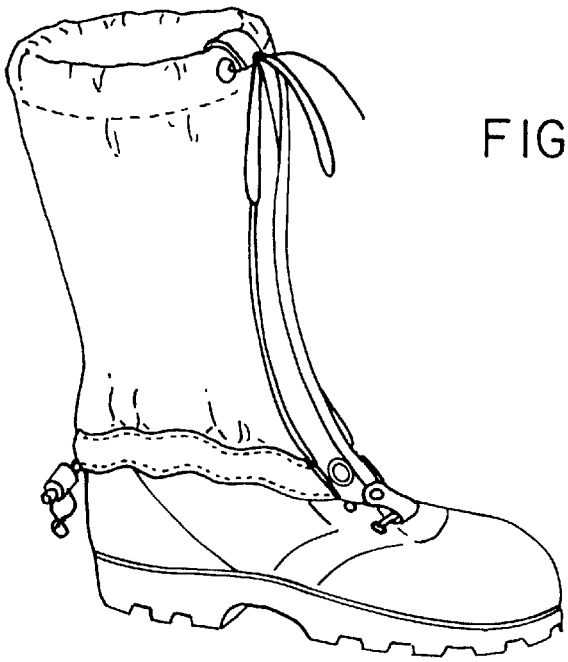

In addition to the features of the gaiter as shown in FIG. 7, the gaiter 36 can also include a drawstring 38 or other cinch member around its central portion as depicted in FIG. 4, which drawstring 38 is of the same general construction as drawstring 23 as shown in FIG. 7. The purpose of this additional drawstring 38 is to adjust the extent to which the gaiter 36 covers the wearer's leg. When the gaiter is to cover a large portion of the wearer's leg, the uppermost drawstring is tightened around the wearer's leg, while the additional drawstring 38 can be in a non-tightened state. When the gaiter 36 is to cover a lesser extent of the wearer's leg this uppermost drawstring is loosened, the upper portion of the gaiter above the additional drawstring 38 is folded over, and then the additional drawstring 38 is tightened around the wearer's leg. This is shown in FIGS. 8A and 8B. This not only allows for an adjustable amount of protection to be provided to the wearer's leg, but also serves to cover and protect the laces of the boot 30 from damage. The portion of the gaiter 36 located above the drawstring 38 can be provided with hooks, snaps or other fasteners which cooperate with structure on the boot 30 to attach this upper portion of the gaiter to the boot 30 when in its folded over position. These additional hooks, fasteners, snaps and structure are of conventional types and thus are not shown in the drawings.

In accordance with a third embodiment of the present invention as shown in FIGS. 5 and 6, the footwear can be a high boot 40 which is of the same general construction as that of the mid-boot 30 of the second embodiment, except that the high boot extends to about the calf of the wearer. Otherwise the embodiment as depicted in FIGS. 5 and 6 is generally the same as that depicted in FIGS. 3 and 4. The high boot 40 and its gaiter 43 can be provided with the same features as are the mid boot 30 and its gaiter 36.

An additional aspect of this third embodiment is that instead of the leg covering being a gaiter, the leg covering can be a pants leg portion. This is shown in FIG. 10. The pants leg portion 41 can be of the same general construction as that of the previously described gaiters, except that the pants leg portion 41 also includes a zipper portion 42 such that the pants leg portion 41 associated with a left footed boot can be attached to the pants leg portion associated with a right footed boot at the crotch portion of the wearer. Instead of the zipper portion 42, other structure can be employed to fasten the pants leg portions to one another, e.g. snaps, buttons or hook and loop fasteners. Additionally, instead of the hook and loop fastener strips provided along lateral edges of the pants leg portion, as are provided with the gaiters of the previous embodiments, a zipper can be used to attach the lateral edges to one another.

In accordance with another aspect of the third embodiment, instead of a leg covering being provided with the high-boot 40, a body covering can be provided with the high-boot 40 to provide even greater protection. This is shown in FIGS. 12 and 13.

As shown in FIG. 12, the body covering can be a sack portion 44. The sack portion 44 can be of the same general construction as that of the previously described gaiters, except that the sack portion includes additional material with a zipper portion 47 such that the sack portion associated with a left footed boot can be attached to the sack portion associated with a right footed boot about the head and torso of the wearer. Instead of the zipper portion, other structure can be employed to fasten the sack portions to one another, e.g. snaps, buttons or hook and loop fasteners. And, instead of the hook and loop fastener strips provided along lateral edges of the sack portions, as are provided with the gaiters of the previous embodiments, a zipper can be used to attach the lateral edges to one another. The sack portion 44 also includes an opening that is closeable by a zipper 48 from inside of the sack portion. This allows the wearer to extend an arm through this opening when attaching sack portions to one another via the zipper portions 47, and then withdraw and conceal the arm within the sack portion.

As shown in FIG. 13, the body covering can be a suit portion 45. The suit portion 45 can be of the same general construction as that of the previously described gaiters, except that the suit portion includes additional material having a sleeve portion 46 to receive an arm of the wearer, and also having a zipper portion 49 such that the suit portion associated with a left footed boot can be attached to the suit portion associated with the right footed boot about the head and torso of the wearer. Instead of the zipper portion, other structure can be employed to fasten the suit portions to one another, e.g. snaps, buttons or hook and loop fasteners. Additionally, instead of the hook and loop fastener strips provided along lateral edges of the suit portion, as are provided with the gaiters of the previous embodiments, a zipper can be used to attach lateral edges of the suit portion to one another.

Figure 11A:
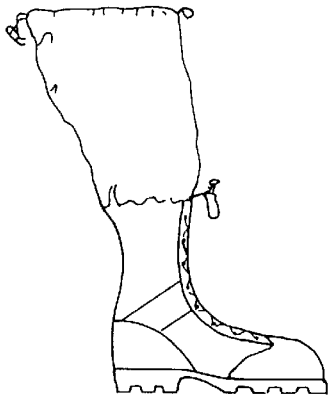
FIGS. 11A–11F show the manner by which the gaiter is stored within the pocket of the footwear.
Figure 11B:
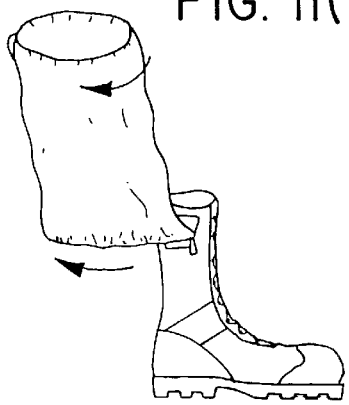
Figure 11C:
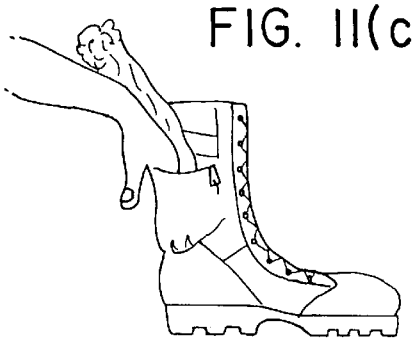
Figure 11D:
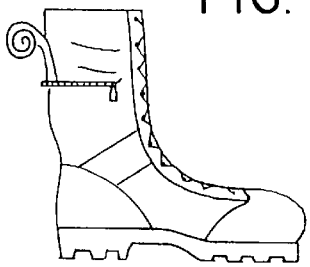
Figure 11E:
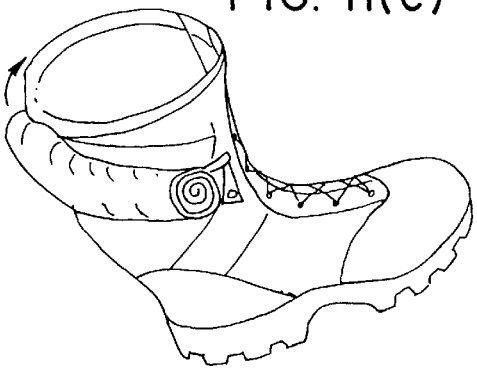
Figure 11F:
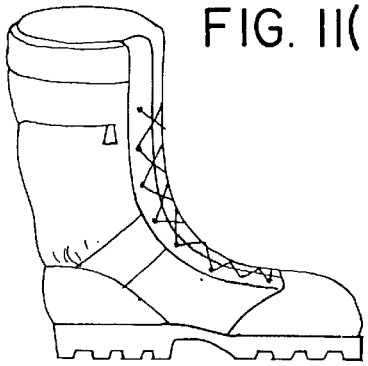

FIGS. 11A–11F show the manner by which the gaiter is stored within the pocket or compartment located on the shoe or boot. Initially, as shown in FIG. 11A the cooperating members of the snap fasteners and the cooperating members of the hook and loop fastener system are removed from one another. Next, as shown in FIG. 11B, the gaiter is reversed upon itself such that the portion that defined an exterior surface of the gaiter when secured around the wearer's leg now defines an interior surface. Then, as depicted in FIG. 11C, about half of the gaiter is tucked into the pocket or compartment. Then, as depicted in FIG. 11D, the remaining exposed portion of the gaiter is rolled upon itself. Then, as depicted in FIG. 11E, the opposite ends of the rolled portion are respectively rolled or otherwise tucked into respective upper corners of the pocket or compartment, and then as depicted in FIG. 11F, the zipper is used to close the pocket or compartment.

Additional features of the invention can include a heating implement to be stored within the compartment or pocket to keep the back portion of the wearer's leg or heel warm. Also, the leg covering or body covering and the footwear can be impregnated with an insect repellant. Furthermore, the material of the gaiter, pants leg portion, sack portion or suit portion can be either water resistant or water proof Although certain aspects of the invention have been disclosed as being associated with certain embodiments of the invention, each aspect of each embodiment of the invention can be used in conjunction with other of the embodiments. For example, the mid-boot can include the pants leg portion, the high-boot and the shoe can include the additional drawstring around the central portion of the gaiter. Also, even though the pockets or compartments are shown to be located on the lower leg receiving portion of the boots, the pockets or compartments of the boots can be provided on the heel receiving portions thereof, or any other portion of the boot. And, even though the pocket or compartment is shown to be located on the heel receiving portion of the shoe, the pocket or compartment of the shoe can also be provided on the toe receiving portion or mid foot receiving portion of the shoe. Additionally, the extent of the wearer's leg that is covered by the footwear and/or the leg covering or body covering can be modified. Similarly, the shape, size, amount and exact location of the pockets or compartments are not limited to those as shown and described, and can be varied depending upon the footwear and its associated leg covering or body covering.

Thus, while preferred embodiments of this invention have been illustrated and described, it will be obvious to those skilled in the art that various changes and modifications may be made therein without departing from the scope of the invention as defined in the appended claims.

What is claimed is:

1. Footwear comprising:

a foot portion to receive a foot and ankle of a wearer;

a lower leg portion extending from said foot portion to receive a lower leg of the wearer;

a collar portion at an upper extremity of said lower leg portion;

a compartment beneath said collar portion and on one of said foot portion and said lower leg portion, said compartment defining a passage that opens to an exterior relative to said foot portion when said compartment is on said foot portion such that said compartment is accessible from the exterior relative to said foot portion, and said compartment defining a passage that opens to an exterior relative to said lower leg portion when said compartment is on said lower leg portion such that said compartment is accessible from the exterior relative to said lower leg portion; and a leg covering or body covering that is interconnected with one of said lower leg portion and said foot portion such that when said compartment is on said lower leg portion and said leg covering or body covering is interconnected with said lower leg portion said leg covering or body covering is storable within said compartment and retrievable from said compartment via said passage, and when said compartment is on said foot portion and said leg covering or body covering is interconnected with said foot portion said leg covering or said body covering is storable within said compartment and retrievable from said compartment via said passage.

2. The footwear according to claim 1, wherein said compartment is on said lower leg portion.

3. The footwear according to claim 2, wherein said leg covering or body covering is interconnected with said lower leg portion by being attached to an inner surface of said compartment.

4. The footwear according to claim 3, wherein said leg covering or body covering is attached to the inner surface of said compartment via at least one of a hook and loop fastener system, a snap fastener system, a zipper, buttons, thread and glue.

5. The footwear according to claim 2, wherein said leg covering comprises a gaiter.

6. The footwear according to claim 5, wherein said gaiter includes structure to secure said gaiter around a leg of the wearer.

7. The footwear according to claim 6, wherein said structure to secure includes snap fasteners.

8. The footwear according to claim 7, wherein said structure to secure further includes a hook and loop fastener system.

9. The footwear according to claim 8, wherein said gaiter includes structure to tighten said gaiter around a leg of the wearer.

10. The footwear according to claim 9, wherein said structure to tighten includes a first cinch member at an upper portion of said gaiter.

11. The footwear according to claim 10, wherein said structure to tighten further includes a second cinch member at an intermediate portion of said gaiter.

12. The footwear according to claim 10, further comprising structure to attach said gaiter to said footwear when said gaiter is removed from said compartment.

13. The footwear according to claim 12, wherein said structure to attach includes fastener portions on said gaiter and said footwear that cooperate with one another.

14. The footwear according to claim 2, wherein said leg covering comprises a pants leg portion.

15. The footwear according to claim 14, wherein said pants leg portion includes attachment structure at an upper portion thereof to secure said pants leg portion with a complementary pants leg portion.

16. The footwear according to claim 15, wherein said attachment structure comprises a zipper portion.

17. The footwear according to claim 2, wherein said body covering comprises a sack portion.

18. The footwear according to claim 17, wherein said sack portion includes attachment structure at an upper portion thereof to secure said sack portion with a complementary sack portion.

19. The footwear according to claim 18, wherein said attachment structure comprises a zipper portion.

20. The footwear according to claim 2, wherein said body covering comprises a suit portion.

21. The footwear according to claim 20, wherein said suit portion includes attachment structure at an upper portion thereof to secure said suit portion with a complementary suit portion.

22. The footwear according to claim 21, wherein said attachment structure comprises a zipper portion.

23. The footwear according to claim 1, wherein said compartment is defined by a stretchable material.

24. The footwear according to claim 23, wherein said stretchable material is more stretchable than material of said foot portion and said lower leg portion.

25. The footwear according to claim 1, further comprising padding that is positioned within said compartment.

26. The footwear according to claim 25, wherein said padding comprises a rubber slab.

27. The footwear according to claim 1, further comprising a heating implement that is positioned within said compartment.

28. The footwear according to claim 1, wherein an insect repellant is impregnated in at least one of said leg covering or body covering, said foot portion and said lower leg portion.

29. Footwear comprising:

a foot portion to receive a foot of a wearer, with said foot portion including a heel portion to receive a heel of the foot of the wearer, a toe portion to receive toes of the foot of the wearer, a mid foot portion to receive a mid portion of the foot of the wearer, and a collar portion at an upper extremity of said heel portion;

a compartment beneath said collar portion and on one of said toe portion, said heel portion and said mid foot portion, said compartment defining a passage that opens to an exterior relative to said heel portion when said compartment is on said heel portion such that said compartment is accessible from the exterior relative to said heel portion, said compartment defining a passage that opens to an exterior relative to said toe portion when said compartment is on said toe portion such that said compartment is accessible from the exterior relative to said toe portion, and said compartment defining a passage that opens to an exterior relative to said mid foot portion when said compartment is on said mid foot portion such that said compartment is accessible from the exterior relative to said mid foot portion; and a leg covering that is interconnected with one of said heel portion, said toe portion and said mid foot portion such that when said compartment is on said heel portion and said leg covering is interconnected with said heel portion said leg covering is storable within said compartment and retrievable from said compartment via said passage, when said compartment is on said toe portion and said leg covering is interconnected with said toe portion said leg covering is storable within said compartment and retrievable from said compartment via said passage, and when said compartment is on said mid foot portion and said leg covering is interconnected with said mid foot portion said leg covering is storable within said compartment and retrievable from said compartment via said passage.

30. The footwear according to claim 29, wherein said compartment is on said heel portion.

31. The footwear according to claim 30, wherein said leg covering is interconnected with said heel portion by being attached to an inner surface of said compartment.

32. The footwear according to claim 31, wherein said leg covering is attached to the inner surface of said compartment via at least one of a hook and loop fastener system, a snap fastener system, a zipper, buttons, thread and glue.

33. The footwear according to claim 30, wherein said leg covering comprises a gaiter.

34. The footwear according to claim 33, wherein said gaiter includes structure to secure said gaiter around a leg of the wearer.

35. The footwear according to claim 34, wherein said structure to secure includes snap fasteners.

36. The footwear according to claim 35, wherein said structure to secure further includes a hook and loop fastener system.

37. The footwear according to claim 36, wherein said gaiter includes structure to tighten said gaiter around a leg of the wearer.

38. The footwear according to claim 37, wherein said structure to tighten includes a cinch member at an upper portion of said gaiter.

39. The footwear according to claim 38, further comprising structure to attach said gaiter to said footwear when said gaiter is removed from said compartment.

40. The footwear according to claim 39, wherein said structure to attach includes fastener portions on said gaiter and said footwear that cooperate with one another.

41. The footwear according to claim 29, wherein said compartment is defined by a stretchable material.

42. The footwear according to claim 41, wherein said stretchable material is more stretchable than material of said foot portion.

43. The footwear according to claim 29, further comprising padding that is positioned within said compartment.

44. The footwear according to claim 43, wherein said padding comprises a rubber slab.

45. The footwear according to claim 29, further comprising a heating implement that is positioned within said compartment.

46. The footwear according to claim 29, wherein an insect repellant is impregnated in at least one of said leg covering and said foot portion.

* * * * *